US010947669B2

(12) United States Patent
Lammi et al.

(10) Patent No.: US 10,947,669 B2
(45) Date of Patent: Mar. 16, 2021

(54) METHOD FOR RECOVERING CONCENTRATED HYDROLYSATE AFTER HYDROLYSIS OF CELLULOSE MATERIAL

(71) Applicant: Valmet AB, Sundsvall (SE)

(72) Inventors: Lari Lammi, Pori (FI); Petteri Kuusisto, Pori (FI); Stefan Antonsson, Stockholm (SE); Sannet Minnaar, Pretoria (ZA)

(73) Assignee: Valmet AB

( * ) Notice: Subject to any disclaimer, the term of this patent is extended or adjusted under 35 U.S.C. 154(b) by 153 days.

(21) Appl. No.: 15/781,919

(22) PCT Filed: Feb. 16, 2016

(86) PCT No.: PCT/SE2016/050117
§ 371 (c)(1),
(2) Date: Jun. 6, 2018

(87) PCT Pub. No.: WO2017/142445
PCT Pub. Date: Aug. 24, 2017

(65) Prior Publication Data

US 2020/0123706 A1 Apr. 23, 2020

(51) Int. Cl.
*D21C 1/02* (2006.01)
*D21C 1/04* (2006.01)
*D21C 3/26* (2006.01)

(52) U.S. Cl.
CPC ..... *D21C 1/02* (2013.01); *D21C 1/04* (2013.01); *D21C 3/26* (2013.01)

(58) Field of Classification Search
CPC ..... D21C 1/02; D21C 1/04; D21C 1/00
See application file for complete search history.

(56) References Cited

U.S. PATENT DOCUMENTS 3,530,034 A * 9/1970 Erickson ..... D21C 1/02 162/19
5,674,360 A * 10/1997 Wyllie ..... D21C 7/06 162/238

(Continued)

FOREIGN PATENT DOCUMENTS

| | | | |
|---|---|---|---|
| CA | 1173602 | A | 9/1984 |
| EP | 2430233 | B1 | 5/2013 |
| WO | 2007090925 | A1 | 8/2007 |

OTHER PUBLICATIONS

Smook, Handbook for Pulp and Paper Technologists, 1992, Angus Wilde Publications, 2nd edition, chapter 9. (Year: 1992).*

(Continued)

*Primary Examiner* — Anthony Calandra
(74) *Attorney, Agent, or Firm* — Lerner, David, Littenberg, Krumholz & Mentlik, LLP

(57) ABSTRACT

A method for obtaining a strong hydrolysate from cellulosic material after a hydrolysis in a batch digester is disclosed. According to the invention the cellulosic material is exposed to a 2 stage hydrolysis with a first steam phase hydrolysis followed by a liquid phase hydrolysis, and wherein the steam phase is conducted such that the degree of packing of the cellulosic material results in at least a 20% up to 100% packing increase. The liquid phase hydrolysis includes adding hot and preferably acidified hydrolysis liquid and not establishing a total L/W ratio above 3.5, but sufficient to keep the cellulosic material under the level of the hydrolysis liquid.

10 Claims, 4 Drawing Sheets

(56) References Cited

U.S. PATENT DOCUMENTS 7,771,565 B2 * 8/2010 Kirov ..... D21C 3/02
162/24
8,262,854 B2 9/2012 Uusitalo et al.

OTHER PUBLICATIONS

Goring, "Thermal Softening of Lignin, Hemicellulose and Cellulose", Physical Chemistry Division, Pulp and Paper Research Institute of Canada, Pulp & Paper Magazine of Canada, vol. 64, Dec. 1963, pp. 1517-1527.
International Search Report for Application No. PCTSE2016050117, dated Oct. 17, 2016.
Lin, C.K., "Prehydrolysis-Alkaline Pulping of Sweetgum Wood (*Liquidambar styraciflua* L.", A thesis submitted to the Graduate Faculty of North Carolina State University, Department of Wood and Paper Science, 1979, pp. 1-121, Raleigh, N.C.
Lin, Sixta, H., "Handbook of Pulp", 2006, pp. 343-345, vol. 1, Wiley-VCH Verlag.
Rydholm, S.E, Chemical Pulping—Multistage Processes, 1968, pp. 649-672, Interscience Publishers, New York, USA.
Vroom, K.E., "The 'H' Factor: A Means of Expressing Cooking Times and Temperatures as a Single Variable", Pulp and Paper Research Institute of Canada, Pulp and Paper Magazine of Canada, 1957, vol. 38, No. 2, pp. 228-231.

* cited by examiner

METHOD FOR RECOVERING CONCENTRATED HYDROLYSATE AFTER HYDROLYSIS OF CELLULOSE MATERIAL

CROSS-REFERENCE TO RELATED PATENT APPLICATIONS

The present application is a national phase entry under 35 U.S.C. § 371 of International Application No. PCT/SE2016/050117 filed Feb. 16, 2016, published in English, which is incorporated herein by reference.

FIELD OF THE INVENTION

The present invention relates to a method for recovering concentrated hydrolysate after hydrolysis of cellulose material in a batch digester.

BACKGROUND OF THE INVENTION

The prehydrolysis-sulfate (Kraft) cooking for the production of special pulps having a high content of alpha cellulose was developed in the 1930's, see e.g. Rydholm, S. E., Pulping Processes, pp. 649 to 672, Interscience Publishers, New York, 1968. The basic idea is to remove as much hemicellulose as possible from cellulose fibers in connection with delignification, so as to obtain a high content of alpha cellulose. This is essential because the various end uses of such pulps, dissolving pulp for instance, do not tolerate short-chained hemicellulose molecules with a grafted molecular structure.

A separate prehydrolysis step permits the desired adjustment of the hydrolysis of hemicelluloses by varying the hydrolysis conditions. In the prehydrolysis-kraft cooking process the necessary delignification is not carried out until a separate second cooking step. The prehydrolysis is carried out at acidic conditions either as a water or steam phase prehydrolysis, or in the presence of a catalyst. In the steam hydrolysis processes, organic acids liberated from lignocellulose during the process, i.e. the wood acidity, perform a major part of the acidification for the hydrolysis, whereas in the water hydrolysis process, small amounts of mineral acid or sulfur dioxide may be added to "assist" the acidification for the prehydrolysis. In the prehydrolysis stage carried out in a steam phase, direct steam is introduced to the chip column in the digester and the only supply of liquid to the chips is the steam condensate besides the cellulose moisture content.

Traditionally after prehydrolyzing the lignocellulosic material in a reactor, the hydrolysate and the prehydrolyzed lignocellulosic material are neutralized in the reactor with alkaline neutralizing liquor so as to produce neutralized hydrolysate and neutralized prehydrolyzed lignocellulosic material. There is hydrolysate both in the free liquid outside the chips and also trapped and immobilized inside the chips. If desired, as much as possible of the hydrolysate can be recovered before the neutralization step in order to be able to utilize the carbohydrates released in the prehydrolysis. A separate washing stage, in which the digester is first filled up with a washing liquid and then the liquid containing the carbohydrates is removed from the digester, can be used between the prehydrolysis and cooking stages. This is time-consuming and, furthermore, unfavorable to the energy balance and produces a very dilute carbohydrate solution.

As a basic rule of thumb for most common wood material it is well known by skilled persons in pulping that a batch digester totally filled with chips such as Norway Spruce have only ⅓ of its volume filled with chips, while almost ⅔ of the digester volume is void volume around the chips. The ⅓ of chip volume in turn contains about ⅓ with wood material, ⅓ with wood moisture and ⅓ with bound air. Hence, wood with natural wood moisture content alone exhibit a L/W (Liquid-to-wood) ratio of about 1. If other lignocellulose material than wood chips are used then the void volume around the cellulose material may decrease in proportion to how well fractionated the material is.

Several techniques has been implemented to increase packing degree of wood chips, including steam swirling in inlet in order to distribute the inflow of chips over the entire cross section of the digester. Steam swirling was developed in the early 1900 by an inventor named Svensson and is called the "filling-Svensson" technique. Further, some additional filling with more chips has also been implemented after a short initial heating of the digester content, as the content becomes more packed after heating. However, this packing by heat exposure is limited during black liquor impregnation, where the content may experience an increased compaction by some 4-5%.

While the batch digesters typically has liquid level detectors, the chip level is typically not monitored, as the batch digester could not be fed with more chips than to a condition where the inlet is filled with chips, i.e. filled to 100%. This is in contrast to continuous digesters and especially steam phase digesters where the chip level needs to be monitored in order to keep the volume of chips in the steam phase at more or less constant volume.

WO 2007/090925 of Valmet, former Metso Paper, describes an improved method for treating lignocellulosic material, wherein the digester and its contents are first heated with direct steam to a predetermined hydrolysis temperature and then a volume of washing liquid is introduced into the digester from one end and which washing liquid is removed from the other end of the digester, which is opposite to the introduction end. Thus the entire digester is filled with washing liquid before any hydrolysate is displaced through the outlet. Now, if one assumes that the void volume around wood chips according to rule of thumb is ⅔ of the total digester volume, high order of dilution of the hydrolysate is obtained.

According to the process described in patent publication U.S. Pat. No. 8,262,854 of Valmet, former Metso Paper, the hydrolysate is recovered by utilizing trickle-bed type downflow of hydrolysate. In this method the first fraction of the trickled-down hydrolysate is collected as a product fraction and the second fraction diluted with wash liquid is discharged from the digester to a hot hydrolysate storage tank to be used as the first trickle flow liquid in the next batch. By the trickle-bed type recovery it is obtained concentrated hydrolysate, but the recovery step is too slow and therefore it is disadvantageous to the pulp quality. Additionally, the treatment is uneven to the contents of the digester; it is obvious that channeling will occur during the treatment, the liquid goes there where it is easiest.

In yet an improvement of the hydrolysate recovery process described in EP2430233 of Valmet, former Metso Paper, is the final hydrolysate recovered by subjecting the batch digester to a circulation while filling the digester with wash liquid until the hydrolysed chips are fully covered in washing liquid and then the hydrolysate is recovered as a product liquor. However, as most batch digesters has no chip level meter the experienced operator needs to add a wash liquid volume close to that of an hydraulically filled digester in order to be certain that the chips are covered by the washing liquid.

After the removal of the hydrolysate the process may continue by a neutralization-cooking process known in the art.

Most of these prior art methods has been developed in small laboratory batch digesters using only a small volume of chips in the digester, typically less than 10 liter of chips, and has not fully utilized effects that may be at hand in commercial batch digesters.

OBJECTS OF THE INVENTION

The invention is a further step in obtaining a concentrated hydrolysate that is beneficial for subsequent extraction of by-products from the dissolved hemicellulose.

Now, the invention is based on a surprising finding that the wood material in a batch digester undergoes a substantial increase in packing degree during steam hydrolysis, which is in contrast to the packing degree increases that has been seen in black liquor impregnation stages where the packing degree only improves by single digit %-ages. In packing degree simulations it has been found that the packing degree may increase almost 100% after a P-factor of 700 and subjected to a compression force of only 14 kPa, which corresponds to only a fraction of the compression force developed in bottom of commercial batch digesters where the compression force is in the order of about 70 kPa by the weight from the chips.

While it has been seen that the "full level" signal has been lost after hydrolysis, no one has identified that the chip level in a packed commercial batch digester is subjected to this high order of compression. The "full level" sensor is used during chip filling/packing and is used to interrupt further filling beyond the point of where chip level may go above the closing valve in the inlet. I.e. a simple on/off signal indicating when the digester is full. Once the digester is full the process starts and there is conventionally no process need to monitor the actual chip level during the process.

This surprising effect found after steam hydrolysis could be used to further limit the dilution of the hydrolysate as less liquid is needed to dissolve most of the hydrolysate after a first steam hydrolysis phase by simple suspension of the cellulose material in a second liquid hydrolysis phase.

In the inventive method is P-factor and Liquor-to-wood (L/W) ratio important but well known process parameters.

P-factor is a defined factor, which is specifically defined as follows:

$$P-\text{factor} = \int_0^t \frac{k(T)}{k_{100°C.}}\,dt = \int_o^t e^{40.48-\frac{15106}{T}}\,dt$$

to control the prehydrolysis stage, taking the temperature and time into account, analogously with the H-factor concept (Vroom 1957), but using the activation energy for acid degradation of carbohydrates according to Lin (1979), Herbert Sixta, Handbook of Pulp, Volume 1, Wiley-VCH Verlag, 2006, pages 343-345.

Note:

Vroom, K. E., 1957, The "H" factor: a means of expressing cooking times and temperatures as a single variable., Pulp Paper Mag. Can. 38(No. 2), 228-231.

Lin, C. K., Prehydrolysis-alkaline pulping of sweetgum wood. PhD thesis, Department of Wood and Paper Science. NCSU, Raleigh N.C., USA, 1979

Liquor-to-wood (L/W) ratio is expressed as liter liquid per kg of oven dry wood. In the liquor is covered any liquid that may be brought with the cellulose material to the digester such as wood moisture or liquids that me be absorbed by the cellulose material during any pretreatments of the cellulose material, such as washing.

The invention is related to hemicellulose extraction, and for a conventional hardwood type such as *Eucalyptus nitens* is the total hemicellulose content about 150 kg/ton of wood and at most could some 100 kg/ton be dissolved and caught in the hydrolysis liquid. Without mechanical pressing could a strong hydrolysate be recovered after a prehydrolysis stage at a carbohydrate concentration of 40-50 kg/m$^3$, and in a final wash out stage could a weak hydrolysate at a concentration of 12-18 kg/m$^3$ be obtained. However, the content of hemicellulose may vary between wood species.

The order of hemicellulose extraction may range from a low residual hemicellulose content below 5% in the pulp, which pulp may be used for dissolving pulp, and to high residual hemicellulose content up to 10% or more, and preferably is the carbohydrate extraction a complementary product to the paper pulp production. In both cases it is important that the concentration of the carbohydrate content is kept high in order to improve further processing of the carbohydrates.

In following example is a prehydrolysis-kraft pulping example of bamboo shown, where the P-factor may range from 260 up to 1570, with a subsequent kraft cook at H-factor in the range of 518-537. The pulp with low hemicellulose content, i.e. pentosans 3.1%, may be used for dissolving pulp, while pulp with high hemicellulose content, i.e. pentosans 10.9%, may be used for paper pulp. In all examples may the inventive prehydrolysis procedure be used.

| | Test 1 | Test 2 | Test 3 | Test 4 |
|---|---|---|---|---|
| Prehydrolysis stage | 180 | 180 | 180 | 160 |
| Temperature, ° C. | 260 | 735 | 1570 | 705 |
| P-factor | 3.4 | 3.5 | 3.7 | 3.5 |
| End pH | | | | |
| Cooking | | | | |
| H-factor | 518 | 537 | 520 | 519 |
| Residual alkali, g/l Total | 15.7 | 15.1 | 16.3 | 15.5 |
| yield, % | 42.0 | 37.6 | 34.8 | 38.7 |
| Screened yield, % | 41.5 | 37.2 | 34.5 | 38.3 |
| Kappa number | 12.7 | 11.7 | 12.4 | 11.8 |
| Intr. viscosity, ml/g | 1200 | 1140 | 880 | 1160 |
| Brightness, % ISO | 21.8 | 32.2 | 30.6 | 31.9 |
| Alpha cellulose, % | 93.7 | 95.8 | 96.2 | 95.6 |
| Pentosans, % | 10.9 | 5.5 | 3.1 | 6.1 |

SUMMARY OF THE INVENTION

The invention is related to cellulose material fed to batch digesters, where said cellulose material may or may not have been treated or soaked in any liquid and subsequently drained from free liquid before being feed to digester, whereby the amount of liquid bound in the chips may span from about a L/W ratio of 1, and up to about 2 at the most, before being subjected to the steam phase hydrolysis. According to the invention the only liquid brought into the steam phase hydrolysis is the liquid that is brought into the digester with the cellulose material, preferably most of it as bound liquid, and the steam condensate that heats the cellulose material.

The inventive method for recovering concentrated hydrolysate after hydrolysis of cellulose material in batch digesters comprising following stages in sequence;

a) Subjecting the cellulose material for a steam phase hydrolysis wherein the resulting total L/W ratio formed by steam condensate and cellulose moisture do not exceed 1.5 if the cellulose material only contain natural wood moisture before steam phase hydrolysis or the resulting total L/W ratio do not exceed 2.5 if the cellulose material has been subjected to washing or any corresponding liquid treatment with subsequent draining before steam phase hydrolysis, and wherein the cellulose material is subjected to a first P-factor exposure during the steam phase hydrolysis resulting in a packing degree increase of at least 20%;

b) Subjecting the cellulose material for a liquid phase hydrolysis by adding hydrolysis liquid covering the packed cellulose material from the steam phase hydrolysis wherein the total L/W ratio formed by steam condensate, cellulose moisture and added liquid do not exceed a total L/W ratio in the range 2.5-3.5, and wherein the cellulose material is subjected to a second P-factor exposure during the liquid phase hydrolysis, c) Recovering a hydrolysate after the liquid phase hydrolysis which hydrolysate corresponds to a volume of 0.5-2.0 in total L/W ratio and which is diluted only by the hydrolysis liquid added.

By this method sequence could a first energy efficient steam hydrolysis be implemented where in principle only the lignocellulosic material needs to be heated, and the second liquid phase hydrolysis may be rapidly implemented at hydrolysis temperature.

In a further embodiment according to the inventive method lies the total P-factor established in the steam phase hydrolysis and the liquid phase hydrolysis in the range 200-1500, and that the first P-factor exposure is 50-95% of the total P-factor and the second P-factor exposure is 5-50% of the total P-factor. By this embodiment is a substantial part of the total hydrolysis established in the steam phase and to such an extent that the required compaction of the material is reached.

In yet a further embodiment of the inventive method is the liquid phase in the digester subjected to circulation during the liquid phase hydrolysis such that the liquid content is circulated at least 2 times through the digester. By this circulation may more of the dissolved carbohydrates be caught in the hydrolysis liquid increasing the yield of carbohydrates, and the liquor gets a more uniform concentration within the digester.

In a preferred embodiment of the inventive method the recovery of the hydrolysate after the liquid phase hydrolysis is obtained by draining free liquid from the digester in at least an initial recovery phase. Such draining could obtain an undiluted hydrolysate at the highest possible concentration of carbohydrates.

The draining may also be followed by recovery of the residual hydrolysate after the liquid phase hydrolysis by displacing free liquid from the digester using another displacement liquid in at least a final recovery phase.

In most applications of the inventive method is the total P-factor established in the steam phase hydrolysis and the liquid phase hydrolysis exceeding 400. This order of P-factor is at least established for some special pulp qualities like dissolving pulp where essentially no residual hemicellulose is wanted in the final pulp. However, some pulp qualities may have residual hemicellulose and may even show better pulp strength if some hemicellulose is kept in the final pulp.

In a preferred embodiment of the inventive method the displacement liquid used is a weak hydrolysate displaced and diluted from a previous hydrolysis stage. If such weak hydrolysate is used to displace the residual hemicellulose may total carbohydrate yield be increased and carbohydrate losses kept at a minimum.

In a further embodiment of the inventive method is the P-factor established in the steam phase hydrolysis exceeding 300. The order of compaction could by this order of P-factor be increased further. And the packing degree increase after the P-factor exposure during the steam phase hydrolysis could exceed 50%.

The hydrolysis liquid used at least in part comprises is a weak hydrolysate displaced and diluted from a previous hydrolysis stage, and optionally comprises additional acidifier. Hence could the hydrolysis liquid in total comprise only weak hydrolysate, or in part comprise weak hydrolysate and possibly also strengthened with acidifier to increase the speed of the liquid phase hydrolysis or if the cellulose material is difficult to process.

DETAILED DESCRIPTION OF THE INVENTION

Figure 1:
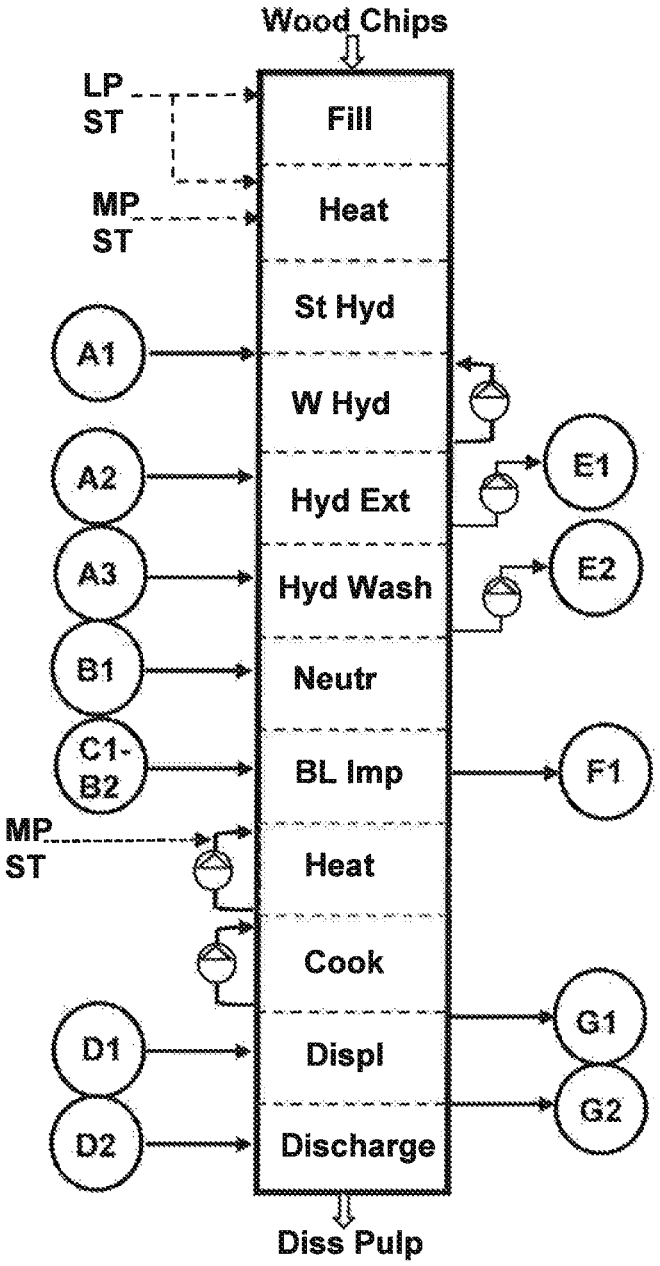
FIG. 1 is a schematic flow chart of the process implemented in a batch digester according to one embodiment of the present invention.

The cooking process according to the invention implemented in a batch digester is schematically shown in FIG. 1 as a flow chart The "Fill" phase: The displacement batch pulping process according to the invention is started by filling the digester with the lignocellulosic material i.e. with the chips. The chip flow enters into the top of the digester. Low pressure (LP) steam is used to ensure good chip packing over the whole digester cross-section using a swirling steam generator in the inlet. During the chip filling, air is evacuated through suction screens arranged in the inlet. Chip filling is stopped after the digester level switch has operated and the capping valve is then closed. The chips are preheated from ambient temperature to about 60-90° C. during the filling phase.

The "Heat" phase: Heating of the chips to full hydrolysis temperature is continued by using first further low pressure (LP) steam from the top and bottom of the digester and the heating is finally continued with medium pressure (MP) steam, until the required temperature is reached i.e. 150-170° C. The digester is kept at this temperature and pressure until the prehydrolysis step is completed, i.e. the required P-factor is reached.

"St Hyd" phase: According to the invention the prehydrolysis step is carried out in a steam phase, where the acids of the cellulose are hydrolyzed by the steam and acidic conditions are created in the digester. The end-pH of the steam prehydrolysis phase varies depending on the cellulose or wood species and the prehydrolysis conditions itself. The pH is typically measured in the condensate formed and varies from 2.5 to 4.0. The steam hydrolysis phase continues until a predetermined packing degree has been obtained, wherein the cellulose material is subjected to a first P-factor exposure during the steam phase hydrolysis resulting in a packing degree increase of at least 20%, and preferably after a P-factor exceeding 100 and more preferably over 400.

"W hyd" phase: Once the steam phase hydrolysis has ended and the packing degree has increased is the batch digester filled, preferably as fast as possible, with a small predetermined amount of liquid (A1) that will form a suspension of the digester content. The hemicellulose rich condensate from the steam phase hydrolysis will be readily suspended in this liquid. As shown in the flow chart may the suspension be subjected to circulation during this phase solving the hemicellulose condensate evenly in the entire liquid volume. The liquid added is preferably already heated to the full hydrolysis temperature and may contain additional acidifiers. The hydrolysis then continuous in a second water hydrolysis phase further dissolving hemicellulose into this liquid from the cellulose material.

"Hyd Ext" phase: After the total P-factor is reached, i.e. after the steam hydrolysis and the water hydrolysis, the extraction step is started by a first draining phase obtaining an undiluted strong hydrolysate (E1), followed by introducing hot washing liquid (A2) to the digester displacing the residual strong hydrolysate from the cellulose material.

The first volume of displaced strong hydrolysate is essentially undiluted and is extracted to a dedicated strong hydrolysate tank in flow E1, and may be sent directly to further processes such as C5-sugar processes.

"Hyd Wash" phase: When the concentration of the displaced strong hydrolysate is dropping, or immediately before it starts to drop, the flow E1 to the strong hydrolysate tank is blocked and finally displaced liquids routed in line E2 are collected in a weak hydrolysate tank, wherein residual hemicellulose is caught in the liquid. As this liquid is almost at hydrolysis temperature it is as shown used as the liquid added, via line A1, as the liquid for forming the water hydrolysis phase.

Figure 2:
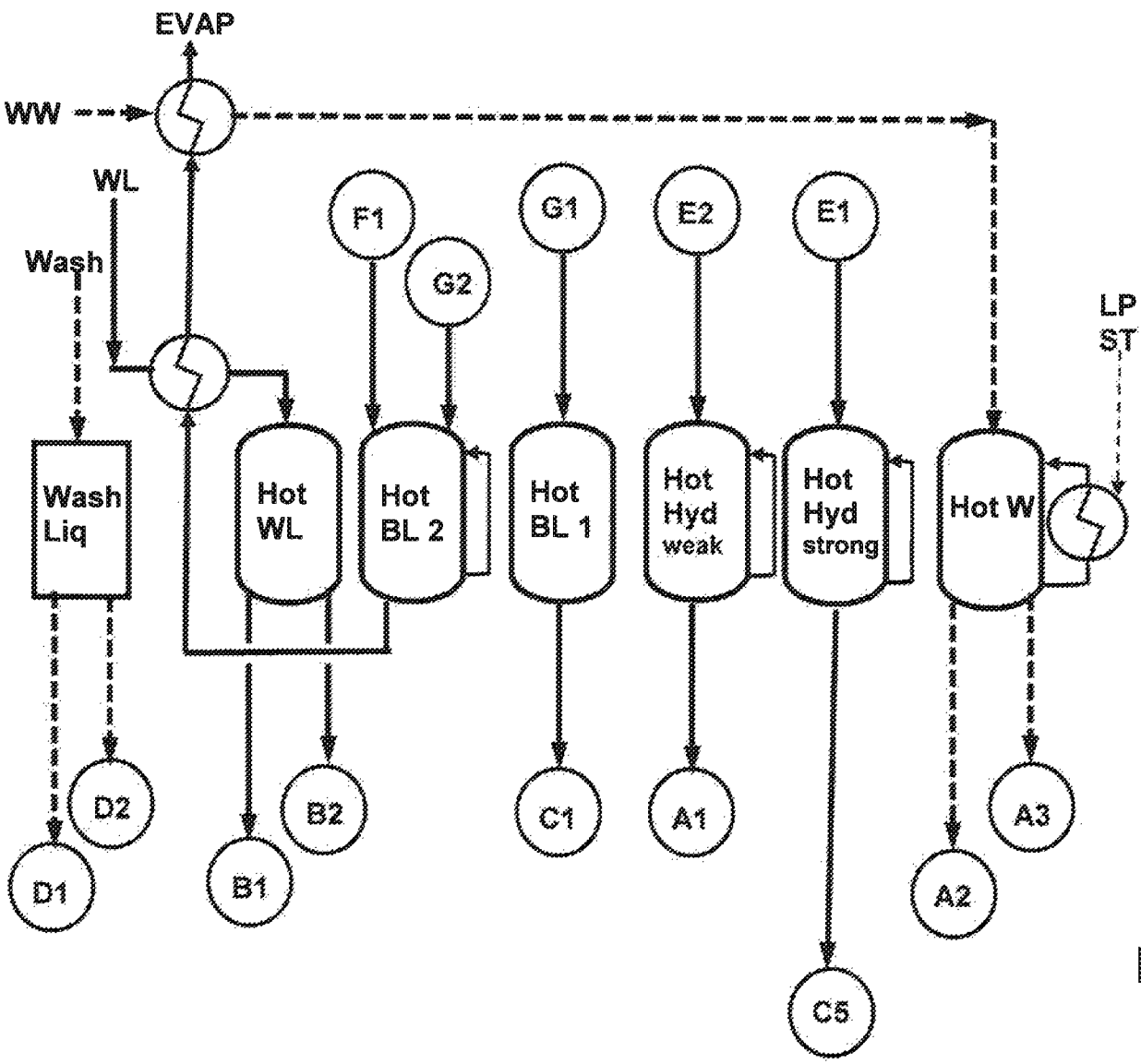
FIG. 2 is a principal layout of the filtrate tank farm used for handling the treatment liquors in a batch digester system according the invention.

"Neutr" phase: The temperature of the hot washing liquid is between 100-174° C., preferably between 140-160° C. and it is pumped into the digester from the bottom thereof. According to one embodiment hot water from "Hot W"/HOT WATER accumulator as shown in FIG. 2 is used as the washing liquid.

According to another embodiment sodium hydroxide may be added to the hot water prior introducing it into the digester, if there is a need to increase the pH of the chips during the recovery step to enhance the stopping of the prehydrolysis.

As shown in the flow chart may also the neutralization phase include addition of white liquor, either cold or as shown here as heated white liquor in the B1 flow.

"BL Imp" phase: The following kraft cooking process starts with addition of hot black liquor in flow C1 and additional white liquor in flow B2, while displacing used neutralization liquor in flow F1 from digester.

"Heat" phase: After impregnation is the digester content exposed to circulation while adding medium pressure steam "MP ST", heating the content to full cooking temperature.

"Cook" phase: After heating to full cooking temperature the circulation continues during the cooking stage.

"Displ" and "Discharge" phases: After cooking the final black liquor is displaced in flow G1 by adding displacement liquid in form of wash liquid in flow D1 in a first displacement phase, and continues with displacement of residual black liquor in flow G2 by adding more wash liquid in flow D2 in a second phase. Once ended the produced pulp is suitable for dissolving pulp production, "Diss Pulp", is pumped out from the batch digester.

In FIG. 2 is shown a principal layout of the filtrate tank farm used for handling the treatment liquors in a batch digester system according the invention and described above.

"WASH LIQUID TANK": Starting from the left hand side the tank farm includes a wash liquid tank, "Wash Liq", receiving wash liquid that may be filtrate from brown stock washing stages after cooking or any alkaline filtrate from bleaching stages following brown stock washing. The temperature of the wash liquid is conventionally at least 70-80° C. and the wash liquid tank may be an atmospheric tank.

"HOT WHITE LIQUOR TANK": White liquor, conventionally holding a temperature about 70-90° C. from the recovery process, is fed to a hot white liquor tank, "Hot WL", via an indirect heat exchanger where the white liquor is heated by the residual heat in the spent cooking liquors that is to be sent to evaporation stages in the recovery process. The heated hot white liquor is sent to both the neutralization phase as well as the black liquor impregnation stage ahead of the kraft cooking stage.

"FINAL BLACK LIQUOR TANK": Final black liquor obtained from both the final stages of neutralization and after cooking is sent to a final black liquor tank, "Hot BL 2", and as shown is the residual heat value in these liquors used in 2 indirect heat exchanger heating the white liquor, WL, as well as the warm water, WW, sent to hot water tank "Hot W". As this tank receives liquors of different pH levels is the tank normally under circulation to even out these differences and avoid settling in the tank.

"PRIMARY BLACK LIQUOR TANK": The first volume of the spent cooking liquor in flow G1, holding full cooking temperature, is sent to a primary black liquor tank, "Hot BL 1", and as shown is this black liquor used in flow C1 to establish the black liquor impregnation stage following neutralization.

"WEAK HYDROLYSATE TANK". The residual hemicellulose suspended in the liquid displaced after hydrolysis is sent in flow E2 to a weak hydrolysate tank, "Hot Hyd weak", and is used as the suspension liquid when forming the water hydrolysis stage. The residual hemicellulose is thus not wasted and instead brought back to the system where the liquid is used to suspend more hemicellulose from the steam hydrolysis phase.

"STRONG HYDROLYSATE TANK": The strongest hydrolysate recovered by draining after the water hydrolysis phase, i.e. flow E1, is sent to a strong hydrolysate tank. "Hot Hyd strong". This high concentration liquor may be sent directly to further processing and recovery of commercial products such as C5-sugar production. Normally this tank is also under circulation to avoid settling in the tank. In some systems this tank may also be subjected to cooling in order to avoid the hemicellulose to be further degraded.

"HOT WASH WATER TANK": Hot wash water is used to wash out and displace the hydrolysate in the acidic phases as alkaline content is to be avoided here. The wash water is sent to this tank, "Hot W", via heaters, and may be put under a heating circulation in the tank.

Figure 3A:
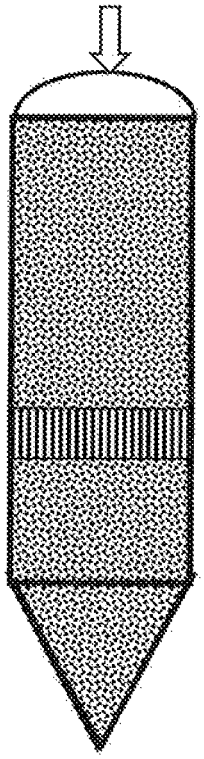
FIG. 3*a* to 3*c* is showing the increase of packing degree that is developed inside a commercial batch digester during steam hydrolysis.
Figure 3B:
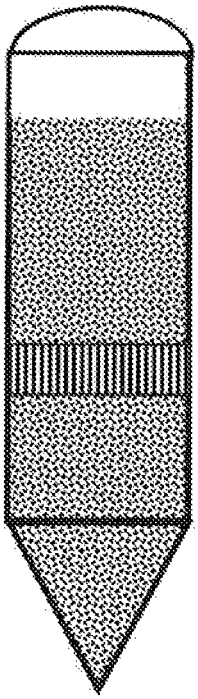
Figure 3C:
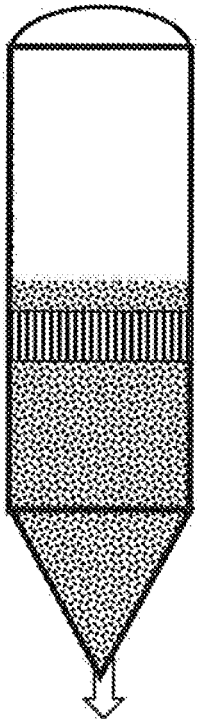

FIG. 3*a* to 3*c* show the increase of packing degree that is developed inside a commercial batch digester during steam hydrolysis. In the first FIG. 3*c* is the batch digester filled to the top with chips (until the level sensor indicates "full"), and thereafter is the inlet valve closed and the chips is heated with pressurized steam reaching a hydrolysis temperature of about 170-180° C. After a while is the signal from the level sensor lost, but as the digester is heated and under pressure could no more chips be supplied, as such late furnish would be subjected to other process conditions than rest of the content. What has been realized in this context is that the content is subjected to extensive compaction and at end of the prehydrolysis is the level of content reduced to about half the volume of the digester which is shown in FIG. 3*c*.

Figure 4:
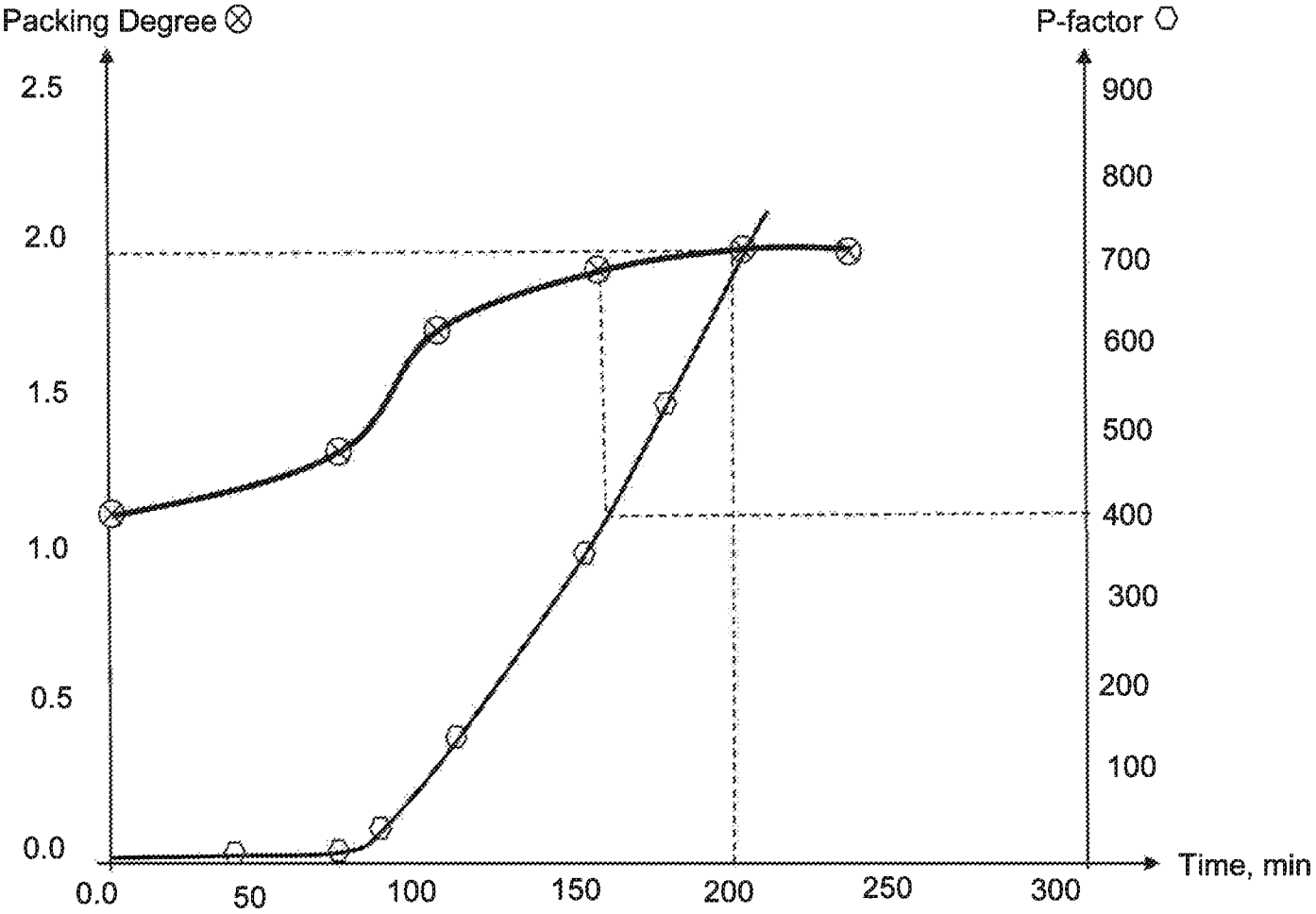
FIG. 4 is a diagram showing how the packing degree increases during development of the P-factor during steam hydrolysis.

How much the content is compressed has been studied in a small laboratory digester where a press piston could be applied on the content of chips during steam phase prehydrolysis conditions. In FIG. 4 is shown a test where the press piston applies a force of about 14 kPa on the content. This order of force should be compared with a force of about 70 kPa that is fully developed in the bottom of a commercial batch digester with a height of about 20 meter due to the weight of the content. This means that in a commercial batch is a linear force applied on the content from top to bottom ranging from 0 to 70 kPa, i.e. with an average force of about 35 kPa. Hence, applying a moderate force of 14 kPa should mimic the possible compression in average in the entire digester by margin. When the force of 14 kPa is applied initially is an incremental increase of packing seen at about 1.1 in packing degree and this increases slightly to about 1.3 in packing degree after some 70 minutes, which corresponds to a neglect able single digit P-factor. However, when the P-factor increases to about 200 is the packing degree increasing rapidly to about 1.7 and continuous to increase to a packing degree approaching 2.0 at a P-factor of about 700 and after 200-250 minutes. Already at a P-factor of about 400 after some 150 minutes is a packing degree of about 1.9 obtained. The test show that the volume of content has reduced its volume by about half if a P-factor of about 700 is reached during the hydrolysis.

The reason for this high order of compaction during hydrolysis may likely be found in the softening temperature of lignin and possibly hemicellulose in the wood matrix. Prior studies (Goring, Pulp & Paper Mag. Can. 64:T-517, 1963) of thermoplasticity of dry wood components has shown that lignin and hemicellulose has softening temperatures around 127-235° C. and 167-217° C. respectively, while cellulose require a temperature of 231-235° C. for thermal softening. A typical steam phase hydrolysis at about 170-180° C. may thus activate lignin and possibly hemicellulose softening. This may explain why typical black liquor impregnation only has revealed single digit compaction of the cellulose material as the black liquor impregnation typically is conducted at some 110-130° C.

The invention may apply to any kind of cellulose material such as hardwood, softwood and annual plants, including bagasse, bamboo and straw. The invention is preferably applied when the cellulose material is in form of well screened chips, where the total void volume between chips may be as high as ⅔ of the total volume, but also pin-chips, chopped straw and saw dust with lower order of total void volume.

As noted before could the original cellulose material contain up to 15% of hemicellulose (*Eucalyptus Nitens*) and liquid draining and displacement techniques may recover ⅔ of this content. In some processes is the hemicellulose extraction given priority and the pulp after hydrolysis may be exposed to extreme mechanical pressing and washing in order to extract more hemicellulose. But this will be at the expense of losses in pulp strength, and where the residual alpha cellulose instead is used for ethanol production or other uses than paper pulp production. The invention may be used for ethanol production mills or, as shown in FIG. 1, in a paper pulp production mill.

The invention claimed is:

1. A batch process for recovering concentrated hydrolysate after hydrolysis of lignocellulose material in batch digesters comprising the following stages in sequence;

a. Subjecting the lignocellulose material to a steam phase hydrolysis wherein (1) the resulting total L/W ratio formed by steam condensate and lignocellulose moisture do not exceed 1.5 if the lignocellulose material only contains natural lignocellulose moisture before the steam phase hydrolysis or (2) the resulting total L/W ratio does not exceed 2.5 if the lignocellulose material has been subjected to washing or any corresponding liquid treatment with subsequent draining before the steam phase hydrolysis, and wherein the lignocellulose material is subjected to a first P-factor exposure during the steam phase hydrolysis resulting in a packing degree increase of at least 20%;

b. Subjecting the lignocellulose material to a liquid phase hydrolysis by adding hydrolysis liquid covering the packed lignocellulose material from the steam phase hydrolysis wherein the total L/W ratio formed by a liquid content comprising steam condensate, lignocellulose moisture and added hydrolysis liquid does not exceed a range of from 2.5-3.5, and wherein the lignocellulose material is subjected to a second P-factor exposure during the liquid phase hydrolysis, and c. Recovering a hydrolysate after the liquid phase hydrolysis which hydrolysate corresponds to a volume of from 0.5-2.0 in total L/W ratio and which is diluted only by the added hydrolysis liquid;

wherein total P-factor established in the steam phase hydrolysis and the liquid phase hydrolysis lies in the range of from 200-1500, and the first P-factor exposure is 50-95% of the total P-factor and the second P-factor exposure is 5-50% of the total P-factor.

2. The method defined in claim 1, wherein that the liquid phase in the batch digester is subjected to circulation during the liquid phase hydrolysis such that the liquid content is circulated at least 2 times through the digester.

3. The method defined in claim 1, wherein the recovery of the hydrolysate after the liquid phase hydrolysis is obtained by draining free liquid from the batch digester in at least an initial recovery phase.

4. The method defined in claim 1, wherein the recovery of the hydrolysate after the liquid phase hydrolysis is obtained by displacing free liquid from the batch digester using another displacement liquid in at least a final recovery phase.

5. The method defined in claim 1, wherein the total P-factor established in the steam phase hydrolysis and the liquid phase hydrolysis exceeds 400.

6. The method defined in claim 4, wherein the displacement liquid used is a weak hydrolysate displaced and diluted from a previous hydrolysis stage.

7. The method defined in claim 5, wherein the P-factor established in the steam phase hydrolysis exceeds 300.

8. The method defined in claim 1, wherein the packing degree increase after the P-factor exposure during the steam phase hydrolysis exceeds 50%.

9. The method defined in claim 4, wherein the added hydrolysis liquid used at least in part comprises a weak hydrolysate displaced and diluted from a previous hydrolysis stage.

10. The method defined in claim 9, wherein the weak hydrolysate comprises additional acidifier.

* * * * *